United States Patent [19]

Frisbie

[11] Patent Number: 4,993,613

[45] Date of Patent: Feb. 19, 1991

[54] GOLF TEE HOLDER

[76] Inventor: James D. Frisbie, 8450 Dygert, Alto, Mich. 49302

[21] Appl. No.: 364,642

[22] Filed: Jun. 12, 1989

[51] Int. Cl.[5] ..... A45F 5/00

[52] U.S. Cl. ..... 224/251; 224/252; 224/918; 273/32 D

[58] Field of Search ..... 224/251, 252, 253, 274, 224/918; 273/32 D, 162 C; 206/315.5

[56] References Cited

U.S. PATENT DOCUMENTS

| | | | |
|---|---|---|---|
| 1,955,650 | 4/1934 | Obarski | 224/918 |
| 3,298,579 | 1/1967 | Smith | 224/918 |
| 3,870,300 | 3/1975 | Amendola | 224/274 |
| 4,573,610 | 3/1986 | Hurner | 224/918 |
| 4,699,303 | 10/1987 | Kline | 224/918 |

*Primary Examiner*—Linda J. Sholl
*Attorney, Agent, or Firm*—Waters & Morse

[57] ABSTRACT

A group of short and preferably flexible tubes receives the shanks of standard golf tees in a gentle force fit. The group is suspended from a player's belt, or can engage the handle ring of a golf bag with the aid of a snap hook or a key ring. The group can be molded integrally with a planar body portion of triangular configuration for the display of ornamental features.

1 Claim, 3 Drawing Sheets

GOLF TEE HOLDER

BACKGROUND OF THE INVENTION

This is a novelty device for golfers, and also has practical utility. A supply of golf tees is almost as necessary in a golf game as the balls and clubs. They are commonly lost when the head of the driver flips them out of the ground as it engages the ball. The replacement supply is usually carried in a trouser pocket, where the tees become intermixed with keys and loose change, and must be separated out after the game is over. Some players carry them in their shirt pocket, or in the pouch of the golf bag. Bending over will often shed the tees out of the shirt pocket, and finding them in the bag pouch can be frustrating. The problem, which is hardly earth shaking, nevertheless presents a need for greater convenience. Some devices similar to cartridge belts are available, but these have found limited acceptance. Some convenient storage device with an element of novelty is sure to find favor, if available at a reasonable price.

SUMMARY OF THE INVENTION

This golf tee holder is formed by a group of short and preferably flexible tubes having an inside diameter selected to provide a gentle forced fit over the shank of a standard golf tee. The cluster is secured together, and a hanger loop is provided for attaching the device to the players belt or golf bag.

DESCRIPTION OF THE PREFERRED EMBODIMENT

Figure 1:
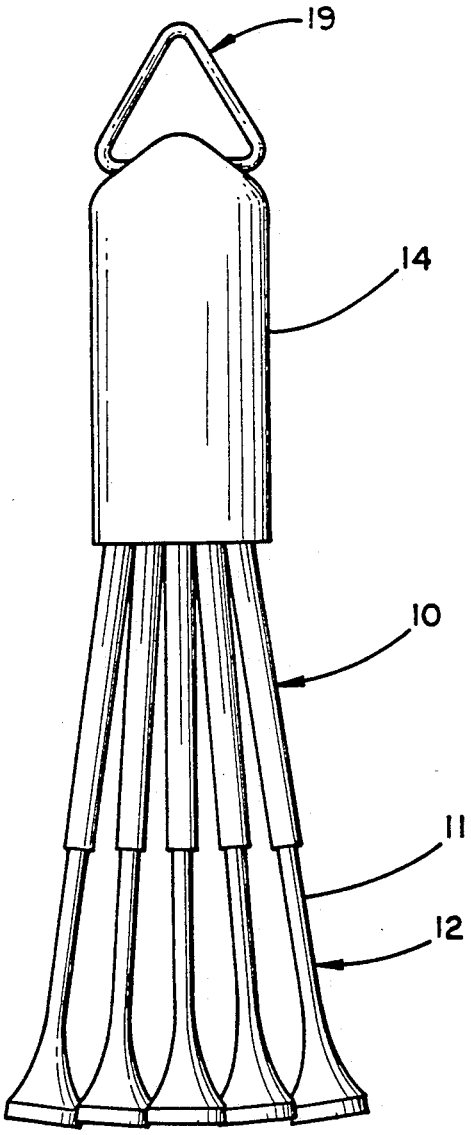
FIG. 1 is a perspective view of the device carrying a supply of golf tees.
Figure 2:
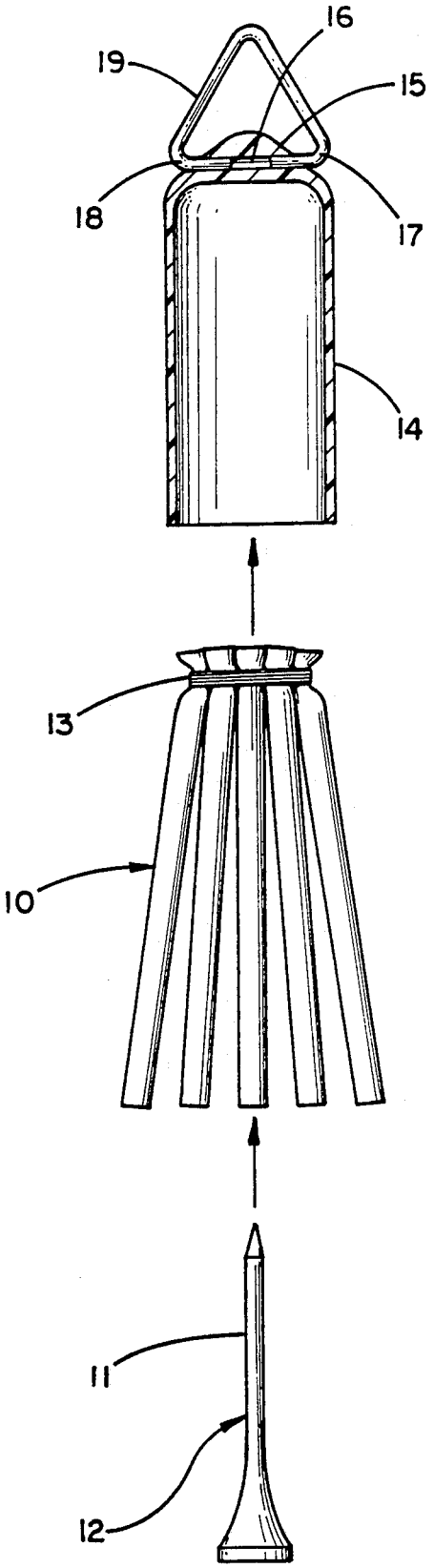
FIG. 2 is an exploded view, partially in section, showing the construction of the FIG. 1 device.

The golf tee holder illustrated in FIGS. 1 and 2 is based upon a cluster group of nine flexible tubes indicated generally at 10. These tubes are preferably of latex rubber, and have an inside diameter selected to provide a gentle force fit over the shank 11 of the conventional golf tee 12. The tubes in the cluster are preferably two to four inches in length, and are gathered together by a binder 13. Several turns of copper wire, with the ends twisted together, have been found to provide adequate retention, when wound tightly around the cluster. When thus assembled, the cluster is inserted in the cap 14 of flexible material, which is preferably of an inside diameter such that it has to be forcibly distended in order to accept the bound cluster. The closed end of the cap has a central area of greater thickness indicated at 15 to provide for the hole 16, which receives the inturned ends 17 and 18 of the wire loop generally indicated at 19. This loop can be supplemented by a snap hook or a key ring (not shown) for ready attachment and disengagement from the player's belt or golf bag.

Figure 3:
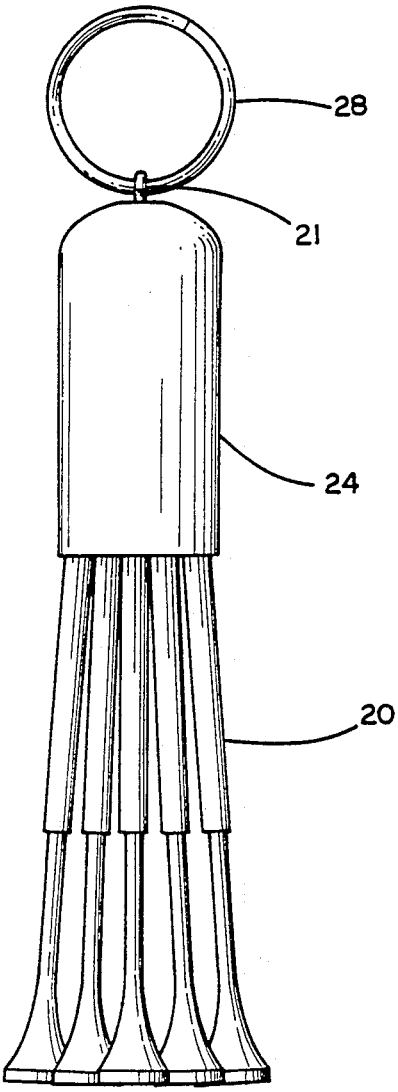
FIG. 3 shows a modified form of the invention.
Figure 4:
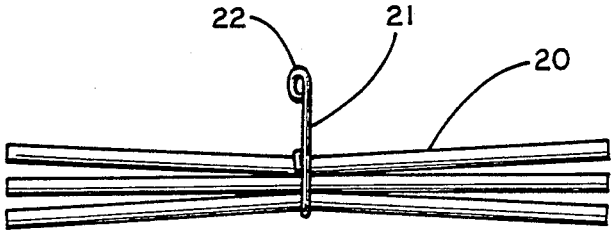
FIG. 4 shows a bound cluster of tubes in the FIG. 3 modification, prior to insertion of this assembly in the cap.
Figure 5:
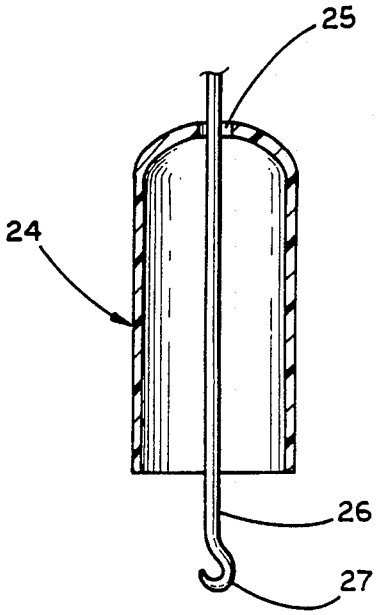
FIG. 5 shows a side elevation of the binding clip.
Figure 5:
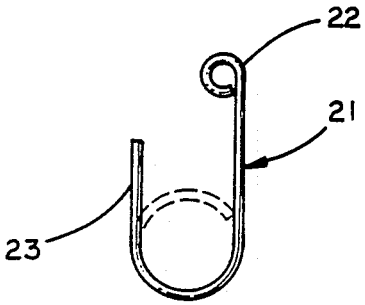
Figure 6:
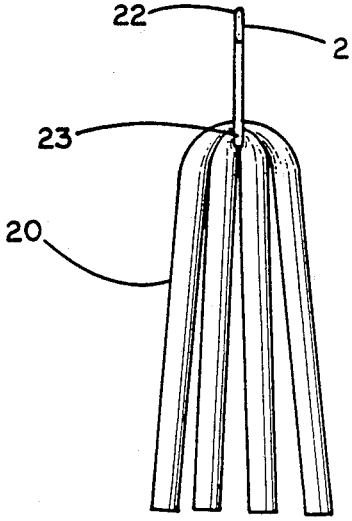
FIG. 6 illustrates the procedure for assembling the device shown in FIG. 3.
Figure 7:
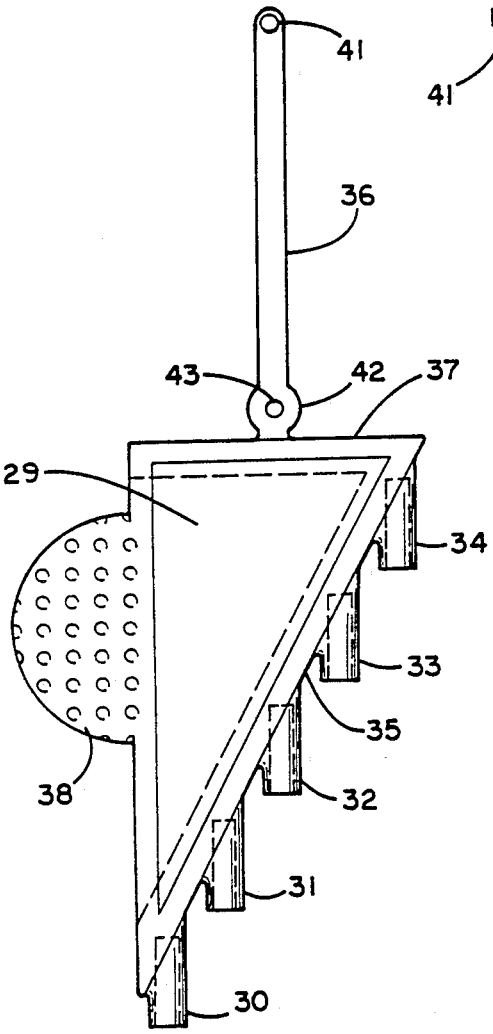
FIG. 7 is a planned view of a further modification of the invention.
Figure 8:
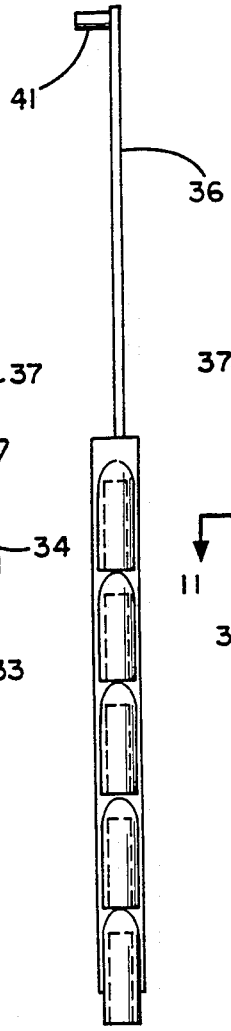
FIG. 8 is a side view with respect to FIG. 7.
Figure 9:
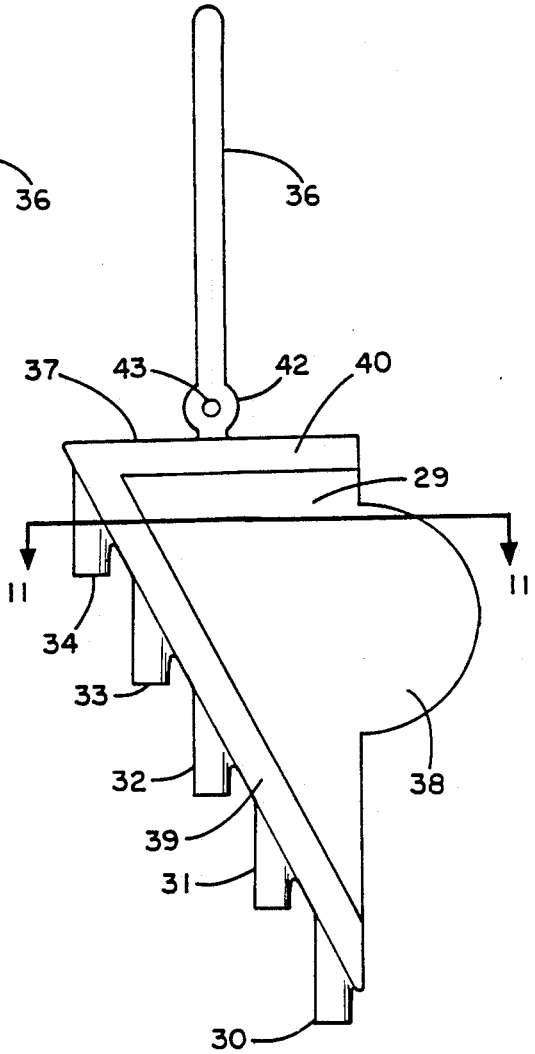
FIG. 9 is a rear view of the FIG. 7 modification.
Figure 10:
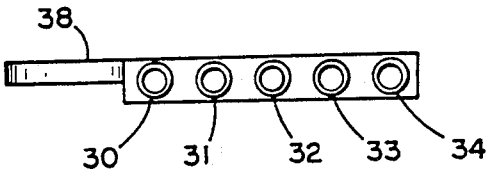
FIG. 10 is a bottom view with respect to FIG. 7.
Figure 11:
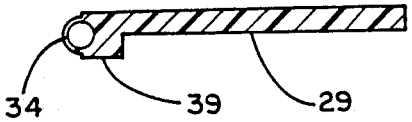
FIG. 11 is a section on the plane 11—11 of FIG. 9.

The modification of the invention illustrated in FIG. 3–5 involves a cluster of tubes 20 bound in the middle by the clip 21 illustrated in FIG. 5. This clip is preferably of a wire selected for a diameter and material such that it will have enough strength to maintain the cluster bound in the FIG. 4 condition. The clip has an eye 22, and an initially U-shaped end 23. After the cluster of tubes has been placed within the open end 23, and suitably constricted into the FIG. 4 condition, the end 23 is closed (either manually or by automatic equipment) to the dotted line position of FIG. 5. The device is assembled to the FIG. 3 condition by the procedure illustrated in FIG. 6. The flexible cap 24 has a hole 25 in its otherwise closed end, through which the instrument 26 is inserted. The hooked end 27 is engaged with the eye 22, and the cap is then pulled down over the cluster of tubes after bending them into a U-shaped condition. This involves taking one end of the cluster shown in FIG. 4 and bending it approximately one hundred eighty degrees so that it lies alongside the opposite end, leaving the clip 21 at the bend of this new configuration. In this condition, the instrument 26 is capable of pulling the cluster of tubes into the open end of the cap 24. Conversely, the cap may be shoved down over the bent cluster of tubes. After this assembly has been completed, the small key ring 28 is worked through the eye 22, after the instrument 26 has been disconnected.

The modification of the invention shown in FIGS. 7 through 11 is adapted to be molded integrally in an injection molding die. The preferred material is a PVC plastic, of about seventy to eighty durometer. The planar body portion 29 is generally triangular in configuration, with tubular receptacles 30–34 extending on parallel axes from the longest side 35 of the body portion. The position of the suspension strap 36 attached to the shortest side 37 establishes that the axes of the tubular receptacles will be generally vertical, when the strap 36 is looped over the belt of the user. The protrusion 38 is semi-circular, and is purely for ornamental purposes. It is intended to represent a half of a golf ball.

The relatively thin-walled tubular receptacles 30–34 preferably have an outside diameter of a quarter of an inch, and an inside diameter at the entrance of about three-sixteenths of an inch. This inside diameter reduces slightly over the depth of the receptacles (about five-eighths of an inch) to provide for "draw" desirable to facilitate the withdrawal of the core components of the molding die that form the interior of these receptacles. It is preferable to form the marginal areas 39 and 40 of the body portion to a thickness of approximately five-sixteenths of an inch, with the rest of the body portion being made about an eighth of an inch in thickness to conserve material. The extension of the thin-walled receptacles from the body portion produces greater resilient accommodation as the tees are shoved into place. The suspension strap 36 is preferably a quarter of an inch wide and about a sixteenth of an inch in thickness, with the projection 41 being preferably about a quarter of an inch long and an eighth of an inch in thickness. The portion 42 of enlarged width is provided with a hole 43 adapted to receive the projection with a light push fit. The planned dimensions of the body portion are not critical, but the right-triangle configuration is preferably approximately two inches on its shortest side, and three and seven-eighths inches on the adjacent side of the right angle. The longest side (the hypotenuse) results from this dimensional relationship.

I claim:

1. A golf tee holder, comprising:

a right-triangular body portion having a short side and a long side;

means for suspending said body portion from a support;

said suspending means attached to said short side of said body portion at a central portion on said short side, thereby positioning said short side horizontally;

said long side having a top at its intersection with said short side;

a plurality of separately depending tubular receptacles sized to frictionally hold a golf tee;

said receptacles being molded integrally on said long side of said body portion, a first of said receptacles being positioned at said top of said long side, with each subsequently positioned receptacle spaced along said long side and extending downwardly beyond the previously-positioned receptacle.

* * * * *

UNITED STATES PATENT AND TRADEMARK OFFICE

CERTIFICATE OF CORRECTION

PATENT NO. : 4,993,613

DATED : 02-19-91

INVENTOR(S) : James D. Frisbie

It is certified that error appears in the above-identified patent and that said Letters Patent is hereby corrected as shown below:

Claim 1, Column 3, line 13, delete "central portion" and substitute --central position--.

Signed and Sealed this

Fifteenth Day of September, 1992

*Attest:*

*Attesting Officer*

DOUGLAS B. COMER

*Acting Commissioner of Patents and Trademarks*